US005753149A

United States Patent [19]

Shepherd et al.

[11] Patent Number: 5,753,149

[45] Date of Patent: May 19, 1998

[54] NOZZLE ASSEMBLY FOR WATER COOLING TOWER

[75] Inventors: Charles E. Shepherd, Houston; Hakija Kovic, Katy, both of Tex.

[73] Assignee: C. E. Shepherd Company, Inc., Houston, Tex.

[21] Appl. No.: 714,390

[22] Filed: Sep. 16, 1996

[51] Int. Cl.[6] ..... B01F 3/04

[52] U.S. Cl. ..... 261/111; 239/600; 239/498; 239/518

[58] Field of Search ..... 261/111; 239/600, 239/498, 518

[56] References Cited

U.S. PATENT DOCUMENTS

| | | | |
|---|---|---|---|
| 3,533,561 | 10/1970 | Henderson | 239/498 |
| 3,617,036 | 11/1971 | Brown | 261/111 |
| 4,084,750 | 4/1978 | Fett | 239/600 |
| 4,390,478 | 6/1983 | Shepherd | 239/600 |
| 4,501,708 | 2/1985 | Shepherd | 261/111 |
| 4,699,217 | 10/1987 | McLennan et al. | 239/600 |
| 5,234,161 | 8/1993 | Harrison, Jr. et al. | 239/600 |

*Primary Examiner*—Tim R. Miles
*Attorney, Agent, or Firm*—Foley & Lardner

[57] ABSTRACT

A nozzle assembly for use in a cooling tower having a hot water deck including a nozzle body positioned in an opening in the deck, the body having mounted at the bottom thereof a diffusion plate for diffusing water, a vortex crown member telescopically received within said nozzle body, the crown member having an orifice ring which defines an orifice opening through which water passes for engaging the diffusion plate, with the nozzle body and the crown member being locked to the deck when the crown member is fully telescopically received with the nozzle body.

16 Claims, 4 Drawing Sheets

NOZZLE ASSEMBLY FOR WATER COOLING TOWER

BACKGROUND OF THE INVENTION

The present invention relates as indicated to a nozzle assembly for water cooling towers, more specifically of the type in which water to be cooled is directed through an orifice opening in a nozzle member secured in an opening in a hot water deck, with the orifice member diffusing the water for cooling by a cross or countercurrent flow of gas, such as air.

Cooling towers of the type described are commonly used for reducing the temperature of cooling water from processing plants and air conditioning systems, for example, with the tower containing a hot water deck in which nozzle assemblies are mounted for converting the stream of water or headwater into droplets to facilitate cooling of the water below the deck. To further enhance the cooling process, the cooling tower is frequently provided with an assembly of fill slats or splash bars positioned below the deck on which the water droplets impinge for further breakup of the droplets to maximize the liquid contact surfaces resulting from the crosscurrent or countercurrent airflow.

A typical nozzle assembly currently in commercial use comprises an orifice body extending downwardly through an opening in the deck, and a top flange which engages the deck when the nozzle is inserted through the opening. Means are provided for frictionally retaining the nozzle assembly in place in the opening, and a water diffuser is positioned below the orifice opening in the path of water descending through the opening. Water impinging upon the diffuser is broken up into droplets and directed radially from the diffuser as uniformly as possible, with the water droplets descending to and contacting fill slat assemblies or the like which further enhance the gas-liquid contact and droplet formation. The diffusers vary considerably in structure, although each is designed to break up and uniformly disperse the water to the extent possible.

In those nozzle assemblies in which the nozzle orifice openly communicates with the headwater above the deck, water flowing through the orifice creates a vortex spiral which tends to suck in debris of various types which may be present in the headwater. This tends to clog the orifice thereby restricting water flow. This requires cleaning or even replacement of the orifice assembly.

Present nozzle assemblies are also characterized by being less than completely satisfactory with respect to water diffusion or distribution. Nozzle assemblies are mounted in the deck in spaced relation, depending upon the size of the cooling tower. However, the diffusion patterns of the nozzle assemblies are frequently such that less than completely uniform distribution is achieved.

SUMMARY OF THE INVENTION

The present invention comprises a two-piece nozzle assembly including a nozzle body adapted to extend downwardly through an opening provided therefor in the hot water deck, and a vortex crown member which has removably mounted therein an orifice ring and which has a cylindrical sleeve which extends downwardly into frictional locking engagement with the nozzle body and the deck. Although the vortex crown member is frictionally retained on the nozzle body, it can be removed without difficulty to change the orifice ring if desired to better accommodate changed water flow. The removal of the vortex crown permits the nozzle body to be removed from the deck opening.

A further feature of the invention is the vortex crown configuration which precludes the forming of vortexes. The crown member includes a radially enlarged flange which directly engages the top surface of the deck. A plurality of wings or tabs extend upwardly from the flange of the crown, with the wings converging at the top and being connected to and supporting a top wall positioned directly above the nozzle orifice. Water engaging the top wall is thus broken up to preclude the formation of a vortex above the orifice opening.

The wings just referred to also form part of an anti-clogging feature which further characterizes the present invention. The wings are preferably four in number, spaced 90° apart, with the radially inner surfaces of adjacent wings defining an opening which is smaller in dimension than the diameter of the nozzle orifice. Thus, any debris or material passing through the openings between adjacent wings is sufficiently small to pass unimpeded through the nozzle orifice thereby precluding clogging of the orifice.

A still further feature of the invention is the novel manner in which the nozzle body is releasibly locked to the deck. The nozzle body is formed with a pair of oppositely disposed outwardly moveable tabs, the inside surface of each of which is formed with a ramp-like projection. When the vortex crown member is moved to operative position in frictional engagement with the nozzle body, the continuous side wall of the vortex crown member engages the projections on the tabs thereby expanding the tabs outwardly. The tabs and projections are dimensioned such that the locking tabs extend outwardly just below the deck thereby locking the assembly in place until the vortex crown member is removed thereby releasing the locking tabs. When the crown member is so removed, the pressure on the locking tabs is released thereby permitting the nozzle body to be removed from the orifice in the deck in the event the orifice ring is desired to be replaced due to changed water flows.

A further feature of the invention is the improved diffusion plate carried by and extending downwardly from the nozzle body. The diffusion plate is uniquely constructed to provide uniform spread or distribution of water in all directions. The diffusion plate is spaced substantially below the nozzle body, and is substantially equal in diameter to the nozzle orifice whereby all water passing through the nozzle orifice engages the diffusion plate.

These and other objects of the invention will become apparent as the following description proceeds, in particular reference to the application drawings.

BRIEF DESCRIPTION OF THE DRAWINGS

In the application drawings.

DETAILED DESCRIPTION OF THE PREFERRED EMBODIMENTS

Figure 1:
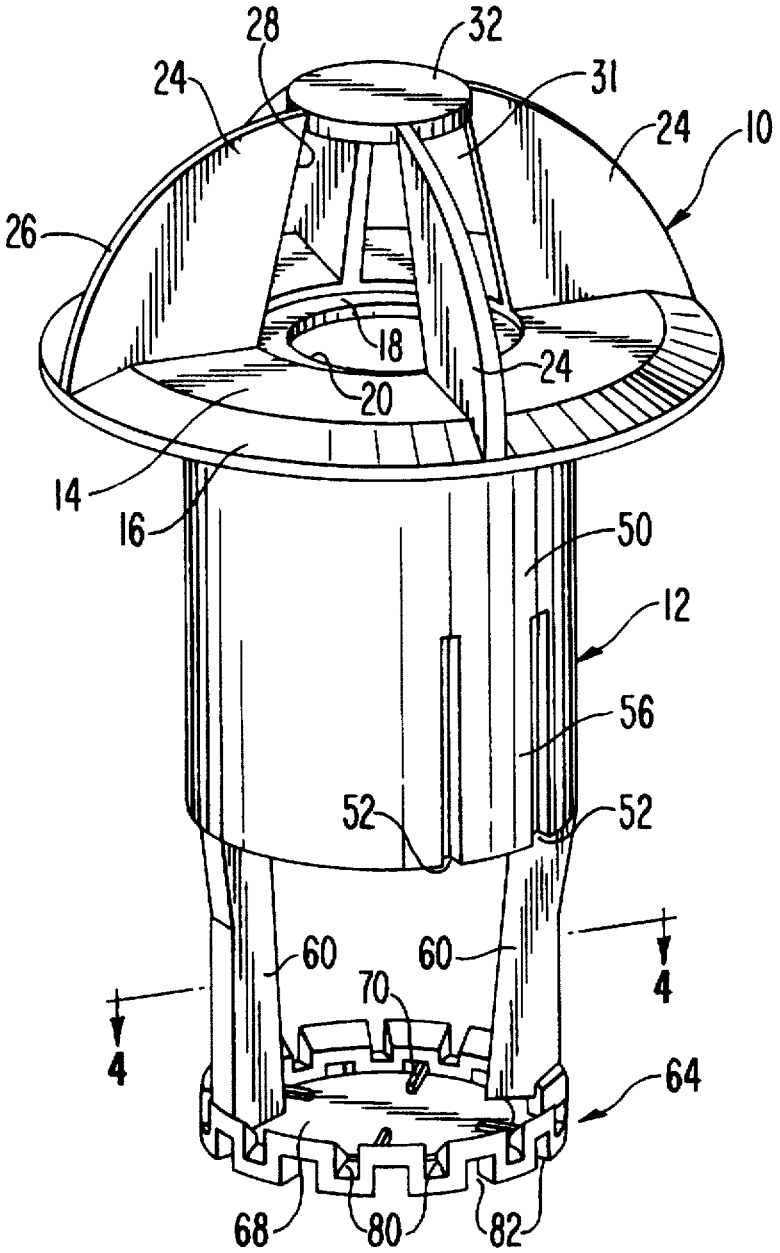
FIG. 1 is a top perspective view showing the nozzle body and the vortex crown in assembled condition.
Figure 2:
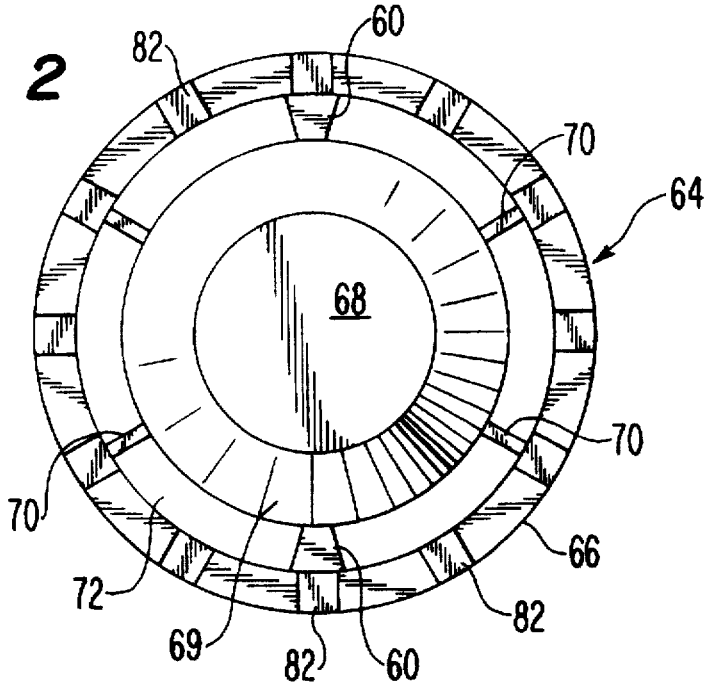
FIG. 2 is a bottom plan view of the nozzle body showing in more detail the diffuser plate.

Referring now in more detail to the application drawings, wherein like parts are indicated by like reference numerals, the nozzle assembly comprising the invention includes a vortex crown generally indicated at 10 extending into a nozzle body generally indicated at 12. For sake of clarity, FIG. 1 does not illustrate the hot water deck to which both members are removably mounted.

The vortex crown 10 comprises an annular flange 14 having a beveled outer edge 16. An orifice ring 18 is mounted within the crown member in a manner to be described below, with the orifice ring defining an orifice opening 20. Water to be cooled enters the nozzle assembly through the orifice opening 20.

Attached to and extending upwardly from the flange 14 and beveled edge 16 are four wings or tabs commonly designated at 24. Each wing 24 has a generally curved outer surface 26 and a linear inner surface 28. The inner surface of each wing is connected at the top thereof to a circular top wall 32 which is oriented above the orifice opening and comparable in diameter to such opening.

The described vortex crown construction not only precludes vortexing of the water entering the orifice opening 20 but also prevents passage of debris that might otherwise clog the orifice opening. The top wall 32 breaks up the headwater above the nozzle assembly and thus prevents the formation of a vortex. A vortex disrupts the normal downward water flow through the nozzle and also serves to draw in debris through the orifice opening, both undesirable features.

The inner surfaces of adjacent wings 24 define therebetween openings commonly designated at 31 which are smaller in dimension at their horizontally widest point than the diameter of the orifice opening. As a result, any debris that is dimensioned to pass through an opening 31 is similarly able to pass downwardly through the orifice opening without clogging the same. Any debris that could potentially clog the orifice opening 20 is precluded from passing to such opening by the relatively smaller dimension of each opening 31.

As a result of the novel construction of the vortex crown, there is a consistent non-vortexing flow of water through the orifice opening and any debris or particles that may be in the headwater to be cooled and which are large enough to potentially clog the orifice opening are effectively filtered out by the wings 24.

Figure 6:
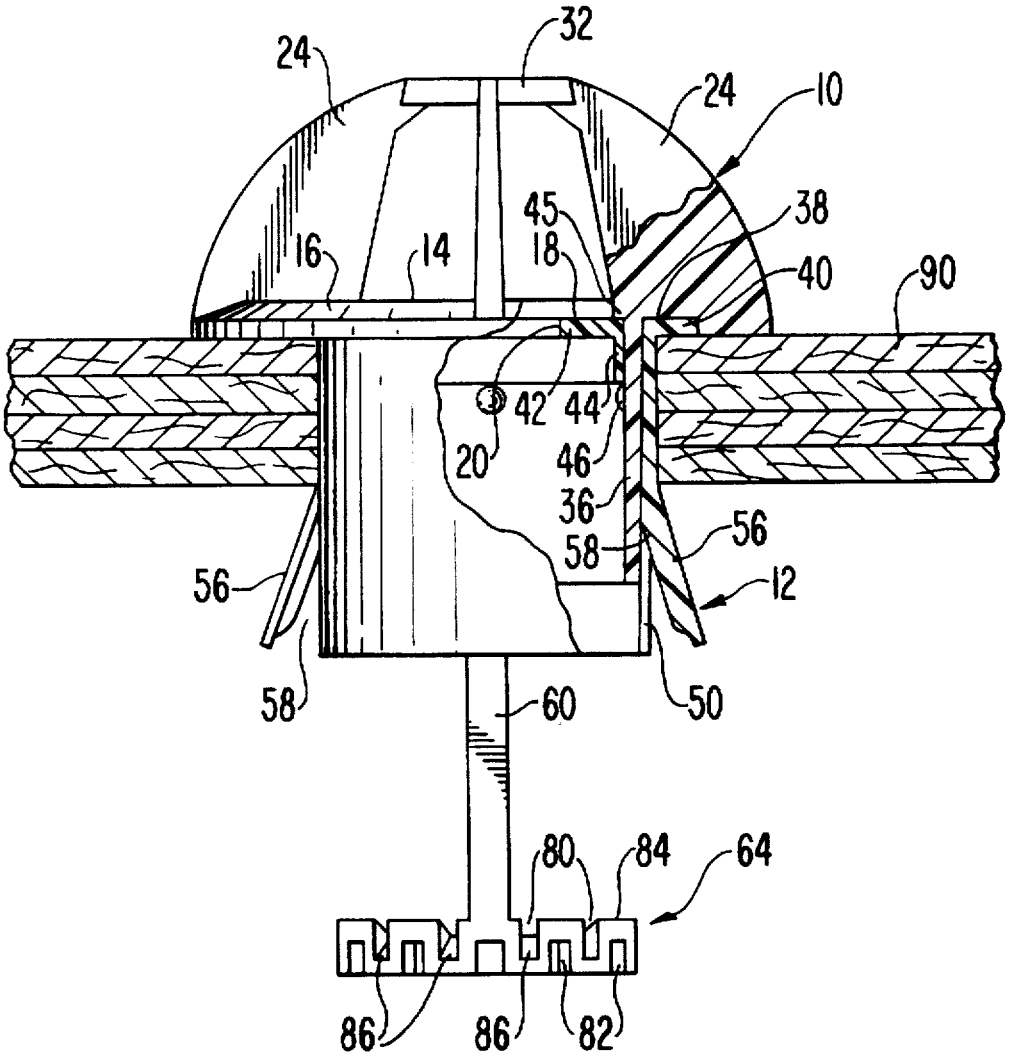
FIG. 6 is a vertical cross-sectional view showing the nozzle assembly in fully assembled and operative position locked to the hot water deck.

Referring to FIG. 6, the vortex crown further includes an integrally formed circular sleeve 36 which extends downwardly within the nozzle body. The flange 14 of the vortex crown is formed with an annular undercut groove 38 at the base of the sleeve 36 which receives the top annular flange 40 of the nozzle body. To enhance the frictional retention of the vortex crown on the flange 40, either or both of the annular groove 38 and the flange 40 may be formed with arcuately spaced small projections or detents which serve to tightly frictionally retain the crown on the nozzle body.

Prior to installing the vortex crown 10 on the nozzle body 12, the removable orifice ring 18 is positioned in the vortex crown. As shown in FIG. 6, the orifice ring 18 includes an annular body portion 42 and a downwardly depending annular skirt 44 integrally formed with the body portion 42. The annular flange 14 is configured to provide an annular shoulder 45 against which the adjacent surface of the orifice ring engages when the ring is positioned within the vortex crown. When so positioned, the orifice ring is approximately at the same height as the flange 40 of the nozzle body which engages the annular grove 38 formed in the vortex crown. The body 18 of the orifice ring defines the central opening 20 which constitutes the orifice opening for the nozzle assembly. The orifice ring, and consequently the size of the orifice opening, can be changed as desired in order to provide an orifice opening correlating in size to the head water conditions above the deck.

In order to relatively tightly frictionally retain the orifice ring within the vortex crown, arcuately spaced projections or detents 46 are preferably provided on the inner surface of the sleeve 36 of the vortex crown, positioned just below the bottom edge of the skirt 44 when the orifice ring is in position. The orifice ring is inserted upwardly past the projections 46 during installation of the ring, with the orifice ring being retained in position by the projection during normal operation of the nozzle assembly. Other arrangements could be provided to accomplish the same purpose, for example, projections and detents formed on either the skirt 44 or sleeve 36 which engage when the orifice ring has reached its installed, FIG. 6 position. Whatever the retention means utilized, the orifice ring 18 can be removed from the vortex crown by application of finger pressure when the vortex crown has been removed from the nozzle body.

The vortex crown, except for the orifice ring, is preferably integrally formed by molding, although various parts could be separately formed and secured together by bonding or the like. The vortex crown is preferably formed of a suitably rigid plastic material, the specific formulation of which forms no part of the present invention. There are numerous types of plastic material which can be satisfactorily used, including, for example, polyolefin copolymer.

Referring to the nozzle body, shown in various parts or sections in FIGS. 1–5, the body includes a cylindrical portion 50 integrally formed with the flange 40 above described, with the inner surface of the cylindrical portion 50 of the nozzle body being dimensioned to receive the cylindrical sleeve 36 of the vortex crown when the respective members are assembled as shown in FIG. 6. The diametrically opposite sides of the cylindrical portion 50 are formed with spaced vertical cut openings 52 which extend from the bottom surface 54 of the cylindrical portion 50 of the nozzle body more than half way toward the flange 40. The vertical openings 52 define therebetween a tab 56 which can be pivoted about hinge line 57. The inside surface of the tab is formed with a projection 58 which extends inwardly from the inner surface of the cylindrical portion 50. The projection can be seen in FIG. 6 where the tabs 56 are shown in locking position. The projections 58 are engaged by the vortex crown when the members are assembled, as will be presently described.

A pair of opposed supporting legs commonly designated at 60 are secured to and extend downwardly from the bottom of the cylindrical portion 50 of the nozzle body, and are connected to and support a diffusion plate generally indicated at 64. Referring to FIGS. 2–5, the diffusion plate has an outer ring 66 which is uniquely configured to provide uniform water distribution, and a bottom wall 68 which is connected to the outer ring 66 through connecting ribs commonly designated at 70 and through the legs 60. The bottom wall 68 is smaller in diameter than the ring 66 and defines therebetween an open annular channel 72. The diameter of the bottom wall 68 of the diffusion plate 64 is slightly larger than the diameter of the orifice opening 20 defined by the orifice ring 18 whereby water descending through the orifice opening impinges on the diffusion plate. The top surface of the bottom wall 68 is preferably flat, with water directed outwardly from the bottom wall either passing downwardly through the annular channel 72 or outwardly through openings formed in the outer ring 66. The bottom wall 68 is bevelled on its bottom surface as shown at 69 so that the area below channel 72 opens up substantially below the top surface of the bottom wall whereby the water flow is not restricted.

Figure 3:
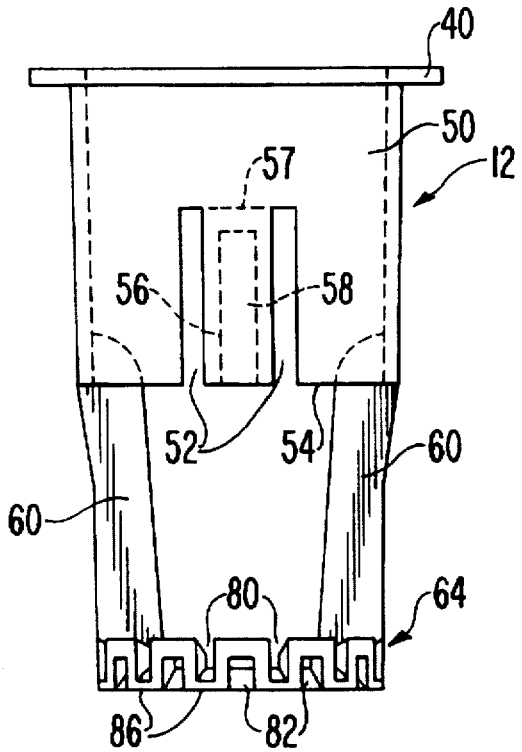
FIG. 3 is a side elevational view of the nozzle body.
Figure 4:
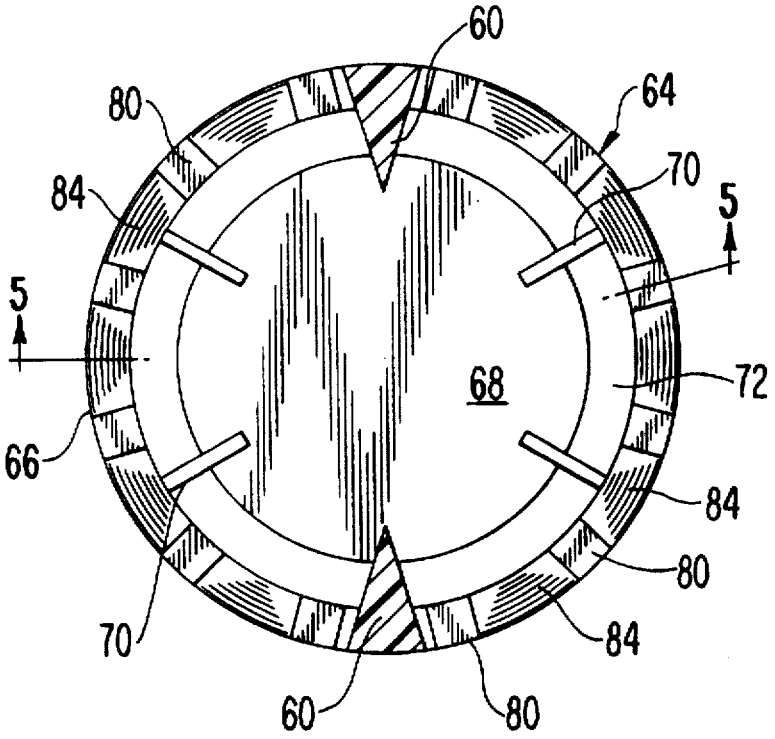
FIG. 4 is a sectional view taken on line 4—4 of FIG. 1, showing in more detail the construction of and openings in the diffusion plate.
Figure 5:
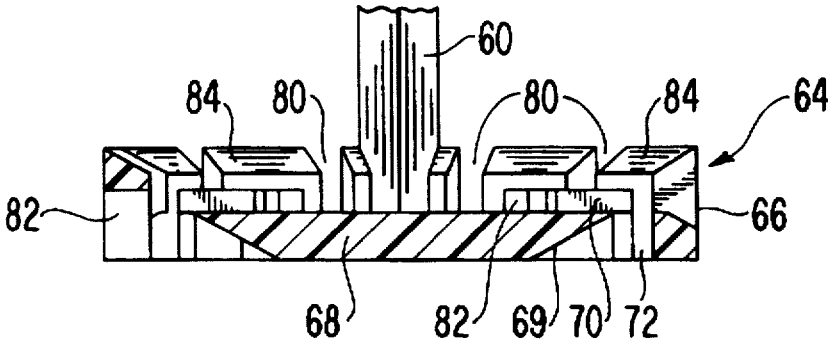
FIG. 5 is a sectional view taken on line 5—5 of FIG. 4.

As perhaps best seen in FIGS. 3, 5 and 6, the ring 66 of the diffusion plate is formed with top openings commonly designated at 80 which open upwardly through the ring, and bottom openings commonly designated at 82 which open downwardly through the bottom surface of the ring. As perhaps best seen in FIG. 5, the solid portions of the ring between and defining adjacent top openings 80 have a top surface 84 which is bevelled upwardly and outwardly thereby deflecting water engaging the surfaces 84 at an angle relative to the bottom wall 68 of the diffusion plate. The bottom wall of each top opening 80 is beveled in the opposite direction, reference being made to beveled surfaces commonly designated at 86 shown in FIGS. 3 and 6. These surfaces cause the water to be deflected outwardly and downwardly.

The pattern of the diffusion plate is such that water impinging upon the bottom wall 68 of the diffusion plate passes outwardly in a very diverse spray pattern. Water is directed generally horizontally through the top openings 80 and the more restricted bottom openings 82. Water is directed downwardly through the annular channel 72 between the bottom wall 68 and the outer ring 66. In addition, water engaging the beveled surfaces 84 and 86 will be reflected at angles relative to the horizontal. The entire arrangement is such that highly uniform distribution of the water is achieved, with water being distributed very uniformly in all directions around the diffusion plate, in a pattern having substantial depth relative to the thickness of the diffusion plate. The uniform distribution of water greatly facilitates gas-liquid contact and consequently cooling of the water. This is particularly important in cooling towers where nozzle assemblies are preferably spaced such that the spray patterns of adjacent nozzles overlap.

The nozzle assembly is shown fully installed and operative in FIG. 6. In the embodiment illustrated, the hot water deck 90 is formed of laminated plywood, although it will be understood that other materials such as various forms of metal or metal alloy could also be utilized. To install the nozzle assembly, the nozzle body 12 is inserted downwardly through an opening 92 provided therefor in the deck, until the flange 40 engages the top surface of the deck. At that time, the opposed tabs 50 are in the plane of the cylindrical portion 56 of the nozzle so that the tabs do not interfere with the installation of the nozzle body in the openings.

After the nozzle body is in position, the vortex crown 10, with orifice ring 18 in position, is installed, with the cylindrical sleeve 36 of the crown extending downwardly within the cylindrical portion 50 of the nozzle body. During downward movement, the bottom edge of the sleeve 36 contacts the projections 58 formed on the inner surface of the tabs 56. Continued downward movement forces the tabs outwardly as shown in FIG. 6, with the tabs being pivoted above hinge lines 57 shown in dash lines in FIG. 3. The position of the tabs and projections 58 are such that the thickness of the deck is accommodated by the cylindrical portion 50 of the nozzle body just above the hinge lines 57. Thus, when the tabs are moved outwardly as shown in FIG. 6 the entire nozzle assembly is locked in place on the deck. Further downward movement of the vortex crown results in the flange 40 formed on the nozzle body engaging the undercut groove 38 formed in the vortex crown, thereby locking the crown to the nozzle body, and both to the deck due to the locking tabs. If desired, either or both of the flange 40 or undercut groove 38 can be formed with means, such as slight projections which extend from the surface of either member or slightly undercut or beveled engaging surfaces, so as to provide supplemental frictional locking engagement between the vortex crown and the nozzle body. The frictional retention force should be such that the vortex crown is maintained in its FIG. 6 operative position during normal use, but the frictional force should not be so high that the vortex crown cannot be manually disengaged from the nozzle body, if a different orifice ring is desired to be used.

Water flow conditions frequently change in cooling towers, and certain orifice diameter openings are best under certain water flow conditions. It is therefore desirable to be able to change the orifice opening as quickly and easily as possible. This can be achieved in accordance with the present invention by removing the vortex crown 10 from engagement with the nozzle body, and changing the orifice ring 18 to a ring having the desired orifice diameter. This can be effected while the nozzle body remains in place. Thereafter, the vortex crown with the changed orifice ring can be reinserted in the nozzle body as shown in FIG. 6, with the tabs 56 serving to lock the assembly in place relative to the deck.

As noted, an important aspect of the invention is the provision of a nozzle assembly capable of creating a consistent uniform diffusion pattern at any height of head water. The diffusion plate in accordance with the present invention is able to accomplish that result.

Water is uniformly spread in all directions, with substantial depth. This unique distribution pattern permits optimum gas-liquid contact with the cross or counter current air flow, thereby achieving maximum water cooling effects.

What is claimed is:

1. A nozzle assembly for use in a cooling tower having a hot water deck comprising:

a nozzle body adapted to be positioned in an opening therefor formed in the hot water deck, a separate vortex crown member adapted to be telescopically received within said nozzle body when the crown member and the body are assembled, an orifice ring removably mounted in said vortex crown and defining an orifice opening through which water passes, a diffusion plate mounted on and positioned below said nozzle body, said diffusion plate being positioned below said orifice opening so that water descending through said orifice opening impinges on and is distributed radially outwardly of said diffusion plate, and means for locking said nozzle body and said crown member to said deck when said crown member is fully telescopically received with said nozzle body, said means for locking said nozzle body and said crown member to said deck comprising at least two opposed tab members hingedly connected to a cylindrical portion of said nozzle body, the inner surface of said cylindrical portion in the region of said tabs being formed with projections engageable by said vortex crown member when the same is installed on said nozzle body, the tabs being forced outwardly away from the plane of the longitudinal portion of the nozzle body and beneath the hot water deck thereby locking the assembly to the deck and preventing removal of the nozzle body until the vortex crown member has been removed.

2. The nozzle assembly of claim 1 wherein said locking means for locking said nozzle body and said crown member comprise opposed tabs formed on said nozzle body.

3. The nozzle assembly of claim 1 wherein said removably mounted orifice ring comprises an annular body portion the inner periphery of which defines said orifice opening, and a peripheral downwardly depending skirt positioned within said sleeve of said vortex crown member when said orifice ring is mounted in position, and means for removably retaining said orifice ring in operative position.

4. The nozzle assembly of claim 3 wherein said vortex crown member includes an annular flange, and said means for retaining said orifice ring in said vortex crown member comprises an annular shoulder formed in said flange of said vortex crown member and against which said annular body portion of said orifice ring engages when said orifice ring is positioned in place, and detents formed on said cylindrical sleeve of said vortex crown member for retaining said orifice ring in place.

5. The nozzle assembly of claim 4 wherein said detents are arcuately spaced and positioned slightly below a bottom edge of said skirt of said orifice ring when said orifice ring is in operative position.

6. The nozzle assembly of claim 1 wherein said diffusion plate comprises an outer ring and a bottom wall spaced from but attached to said outer ring so as to form an annular channel therebetween, said outer ring being formed with a plurality of arcuately spaced openings uniformly positioned around the periphery of said ring and above the plane of said bottom wall, water being distributed uniformly through said openings.

7. The nozzle assembly of claim 6 wherein said bottom wall of said diffusion plate is bevelled on its bottom surface, with the bottom wall being of reduced thickness immediately adjacent to said annular channel between said outer ring and said bottom wall, whereby water passing downwardly through said channel passes relatively unrestrictedly.

8. The nozzle assemble of claim 6 wherein said openings formed in said outer ring comprise alternately spaced top openings which open upwardly through the top surface of said ring, and alternate bottom openings which open downwardly through the bottom surface of said ring, said top and bottom openings being partially or entirely above the top surface of said bottom wall whereby water reflected outwardly from said bottom wall of said ring is uniformly distributed through said openings.

9. The nozzle assembly of claim 8 wherein said top openings are defined at the bottom thereof by a bevelled surface directed outwardly and downwardly relative to the plane of said bottom wall of said diffusion plate, and wherein said ring between said top openings is bevelled upwardly and outwardly relative to a horizontal plane through said bottom wall of said ring, whereby water impinging upon said bottom wall of said ring is directed outwardly generally horizontally through said top and bottom openings, and is directed both upwardly and outwardly and downwardly and outwardly by said bevelled surfaces thereby to provide a diffusion pattern which is peripherally uniform and of around said outer ring but also provides substantial depth above and below the plane of said bottom wall of said diffusion plate, thereby increasing the gas-liquid contact between said water droplets and cooling air passing over said water droplets.

10. A nozzle assembly for use in a cooling tower having a hot water deck comprising:

a nozzle body adapted to be positioned in an opening therefor formed in the hot water deck, a separate vortex crown member adapted to be telescopically received within said nozzle body when the crown member and the body are assembled, an orifice ring removably mounted in said vortex crown and defining an orifice opening through which water passes, a diffusion plate mounted on and positioned below said nozzle body, said diffusion plate being positioned below said orifice opening so that water descending through said orifice opening impinges on and is distributed radially outwardly of said diffusion plate, and means for locking said nozzle body and said crown member to said deck when said crown member is fully telescopically received with said nozzle body, and wherein said vortex crown member comprises an annular flange and an integrally formed cylindrical sleeve extending downwardly within the nozzle body when said crown member and said nozzle body are operationally engaged, said crown member being formed with a plurality of arcuately spaced wings extending upwardly from said flange, and a top wall supported by and connected to said wings and spaced from said flange, said top wall being directly in the path of water entering said orifice opening and precluding the formation of vortexes immediately above said orifice opening.

11. The nozzle assembly of claim 10 wherein the arcuate spacing of said wings is less than the diameter of said orifice opening whereby material passing between adjacent wings is smaller than the diameter of said orifice opening thereby preventing clogging of said orifice opening.

12. The nozzle assembly of claim 10 wherein said vortex crown member is formed with an annular groove in the bottom surface of said flange, and wherein said nozzle body includes an annular, radially outwardly directed top flange engaging the hot water deck, the groove formed in said vortex crown member engaging the top flange of said nozzle body when the vortex crown member and nozzle body are assembled thereby retaining said vortex crown member on said nozzle body.

13. A nozzle assembly for use in a cooling tower having a hot water deck comprising:

a nozzle body adapted to be positioned in an opening therefor formed in the hot water deck, a separate vortex crown member adapted to be telescopically received within said nozzle body when the crown member and the body are assembled, said vortex crown member having an orifice ring removably mounted therein and including an annular flange, an integrally formed cylindrical sleeve extending downwardly within the nozzle body when said crown member and said nozzle body are operationally engaged, a plurality of arcuately spaced wings extending upwardly from said flange, and a top wall supported by and connected to said wings and spaced from said flange, said top wall being directly in the path of water entering said orifice opening and precluding the formation of vortexes immediately above said orifice opening, and a diffusion plate positioned below said nozzle body to uniformly distribute water impinging thereon.

14. The nozzle assembly of claim 13, further including means for locking said nozzle body and said crown member to said deck, comprising at least two opposed tab members hingedly connected to a cylindrical portion of said nozzle body, the inner surface of said cylindrical portion in the region of said tabs being formed with projections engageable by said vortex crown member when the same is installed on said nozzle body, the tabs being forced outwardly away from the plane of the longitudinal portion of the nozzle body and beneath the hot water deck thereby locking the assembly to the deck and preventing removal of the nozzle body until the vortex crown member has been removed.

15. A nozzle assembly for use in a cooling tower having a hot water deck comprising;

a nozzle body adapted to be positioned in an opening therefor formed in the hot water deck, a separate vortex crown member adapted to be telescopically received within said nozzle body when the crown member and the body are assembled, an orifice ring removably mounted in said vortex crown and defining an orifice opening through which water passes, and a diffusion plate mounted on and positioned below said nozzle body, said diffusion plate being positioned below said orifice opening so that water descending through said orifice opening impinges on and is distributed radially outwardly of said diffusion plate, said diffusion plate comprising an outer ring and a bottom wall spaced from but attached to said outer ring so as to form an annular channel therebetween, said outer ring being formed with a plurality of arcuately spaced openings uniformly positioned around the periphery of said ring and above the plane of said bottom wall, water impinging on said bottom wall being distributed uniformly radially outwardly through said openings, and wherein said openings formed in said outer ring of said diffusion plate comprise alternately spaced top openings which open upwardly through the top surface of said ring, and alternate bottom openings which open downwardly through the bottom surface of said ring, said top and bottom openings being partially or entirely above the top surface of said bottom wall whereby water reflected outwardly from said bottom wall of said ring is uniformly distributed through said openings.

16. The nozzle assembly of claim 15, wherein said top openings are defined at the bottom thereof by a bevelled surface directed outwardly and downwardly relative to the plane of said bottom wall of said diffusion plate, and wherein said ring between said top openings is bevelled upwardly and outwardly relative to a horizontal plane through said bottom wall of said ring, whereby water impinging upon said bottom wall of said ring is directed outwardly generally horizontally through said top and bottom openings, and is directed both upwardly and outwardly and downwardly and outwardly by said bevelled surfaces thereby to provide a diffusion pattern which is peripherally uniform and of substantial depth above and below the plane of said bottom wall of said diffusion plate, thereby increasing the gas-liquid contact between said water droplets and cooling air passing over said water droplets.

* * * * *